US009142381B2

(12) United States Patent
Onken

(10) Patent No.: US 9,142,381 B2
(45) Date of Patent: Sep. 22, 2015

(54) X-RAY TUBE FOR GENERATING TWO FOCAL SPOTS AND MEDICAL DEVICE COMPRISING SAME

(75) Inventor: Volker Onken, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 494 days.

(21) Appl. No.: 13/319,612

(22) PCT Filed: Jun. 10, 2010

(86) PCT No.: PCT/IB2010/052578

§ 371 (c)(1),
(2), (4) Date: Nov. 9, 2011

(87) PCT Pub. No.: WO2010/146504

PCT Pub. Date: Dec. 23, 2010

(65) Prior Publication Data

US 2012/0082300 A1 Apr. 5, 2012

(30) Foreign Application Priority Data

Jun. 17, 2009 (EP) ..... 09162949

(51) Int. Cl.

| | |
|---|---|
| ***H01J 35/10*** | (2006.01) |
| ***H01J 35/06*** | (2006.01) |
| ***H01J 35/04*** | (2006.01) |
| ***H05G 1/56*** | (2006.01) |

(52) U.S. Cl.

CPC ..... *H01J 35/06* (2013.01); *H01J 35/045* (2013.01); *H05G 1/56* (2013.01); *H01J 2235/068* (2013.01)

(58) Field of Classification Search

CPC ..... H01J 2235/068; H01J 35/08
USPC ..... 378/124, 134
See application file for complete search history.

(56) References Cited

U.S. PATENT DOCUMENTS

| | | | | |
|---|---|---|---|---|
| 3,946,261 | A | 3/1976 | Holland et al. | |
| 5,621,781 | A | 4/1997 | Blake et al. | |
| 5,844,963 | A * | 12/1998 | Koller et al. | 378/136 |
| 2002/0126798 | A1 * | 9/2002 | Harris et al. | 378/136 |
| 2006/0002525 | A1 | 1/2006 | Bettis et al. | |

(Continued)

FOREIGN PATENT DOCUMENTS

| | | | |
|---|---|---|---|
| DE | 102009044302 | A1 | 4/2010 |
| EP | 0051430 | A1 | 5/1982 |
| EP | 0588432 | A1 | 3/1994 |
| GB | 2034967 | A | 6/1980 |

(Continued)

*Primary Examiner* — Hoon Song

(57) ABSTRACT

An X-ray tube for generating two focal spots displaced with respect to each other and a medical device using such X-ray tube are proposed. The X-ray tube (1) comprises a cathode (7) and an anode (9) wherein the cathode (7) comprises a first electron emitter (15) adapted for emitting a first electron beam (17) for generating a first focal spot (25) on the anode (9) and a second electron emitter (19) for emitting a second electron beam (21) for generating a second focal spot (27) on the anode (9). Therein, each electron emitter (15, 19) comprises an associated switchable grid (37, 39) for blocking the respective emitted electron beam (17, 21). In order to realize a desired displacement of the first and second focal spots (25, 27) in a y-direction, the first and second electron emitters (15, 19) may be displaced in the z-direction. Due to the focal spots (25, 27) being displaced in y-direction, an overall resolution of for example a high quality CT scanner may be significantly enhanced.

11 Claims, 4 Drawing Sheets

(56) References Cited

U.S. PATENT DOCUMENTS

| | | | | |
|---|---|---|---|---|
| 2009/0153010 | A1* | 6/2009 | Perkins | 313/161 |
| 2010/0183117 | A1* | 7/2010 | Tsumuraya et al. | 378/9 |

FOREIGN PATENT DOCUMENTS

| | | | |
|---|---|---|---|
| WO | 2007116329 | A1 | 10/2007 |
| WO | 2007142999 | A2 | 12/2007 |

* cited by examiner

X-RAY TUBE FOR GENERATING TWO FOCAL SPOTS AND MEDICAL DEVICE COMPRISING SAME

FIELD OF THE INVENTION

The present invention relates to an X-ray tube for generating two focal spots on an anode. Furthermore, the invention relates to a medical device comprising such X-ray tube.

BACKGROUND OF THE INVENTION

The present invention and its technical background will be described herein in conjunction with high power X-ray tubes for use with high quality CT scanners and the like. It is to be appreciated, however, that the invention will also find application in conjunction with conventional X-ray diagnostic systems and other penetrating X-radiation systems for medical and non-medical examinations.

Typically, a high power X-ray tube includes an evacuated envelope or housing which holds a cathode filament through which a heating current or filament current is passed in order to serve as an electron emitter for thermionic emission of electrons. A high electrical potential, typically in the order of 100 to 200 kV, is applied between the cathode and the anode which are also located within the evacuated envelope. This potential causes a tube current or beam of electrons to flow from the cathode to the anode through the evacuated region in the interior of the evacuated envelope. The electron beam impinges on a small area of a focal spot of the anode with sufficient energy to generate X-rays. The X-rays may then be transmitted through an object to be observed such as a patient. While a portion of the X-rays will be absorbed within the object, the transmitted X-rays may be detected by an X-ray detector arranged at an opposite side of the object.

In order to increase the resolution of the CT scanner, it may be desirable to modulate a position of the focal spot between two or more positions, thereby creating two locally distinct point sources of X-radiation. High quality CT scanners may use a movement of the focal spot to double the resolution of the imaging system.

In a conventional X-ray tube design, a cathode is provided for emitting an electron beam towards a rotating disk-shaped anode such that a focal spot is generated on a slanted X-ray emitting surface of the anode. The generated X-rays are emitted in a direction substantially perpendicular to a direction of the impinging electron beam.

In such X-ray tube, it may be advantageous to provide a focal spot which can be moved in a direction of the anode's rotating axis in order to be able to generate two distinct focal spots. This direction typically coincides with a direction of the impinging electron beam and is usually referred to as y-direction. A direction perpendicular to the y-direction, i.e. the typical direction of the emitted X-rays from the anode towards the X-ray window of the X-ray tube and then towards the patient is usually referred to as z-direction. A direction perpendicular to both, the y-direction and the z-direction, i.e. a direction tangential to the rotating anode disk, is usually referred to as x-direction.

In such typical X-ray tube design, the desired movement of the focal spot and of the emitted X-ray beam in y-direction may be obtained by a movement of the electron beam in the z-direction, i.e. in a direction towards the detector.

Conventionally, two different methods have been employed to control and move the position and/or width of the focal spot of an X-ray tube.

One method of focal spot control employs electrostatic grids or biasing electrodes associated to a single electron emitting filament of the cathode. Voltages on the two electrostatic grids may be varied to change the location as well as the width of an electron beam impinging on the focal track of the rotating anode. However, such electrostatic grids for controlling both, the position and the width of a focal spot, may require a special complex and expensive grid design.

Another method of focal spot control may employ a magnetic yoke in order to create a magnetic field that affects a path of an electron beam emitted from the anode. However, the provision of magnetic yokes within a housing of an X-ray tube may require a special expensive design of the whole X-ray tube. For example, the magnetic yoke tube requires two additional connections to be passed through the X-ray tube housing, making it incompatible with many CT systems. In addition, the magnetic fields employed to deflect and focus the electron beam may not be moved in a square wave fashion between the two focal spot positions, thereby potentially creating a gap in the collected X-ray detection data.

SUMMARY OF THE INVENTION

Accordingly, there may be a need for an improved X-ray tube design allowing to overcome at least some of the above-described deficiencies of prior art approaches. Particularly, there may be a need for an X-ray tube having a simple structural design while allowing to generate two distinct focal spots. Furthermore, there may be a need for such improved X-ray tube design which is compatible with many conventional X-ray systems and may therefore be integrated into such X-ray systems with only small changes.

According to a first aspect of the present invention, an X-ray tube comprising a cathode and an anode is proposed. The cathode comprises a first electron emitter adapted for emitting a first electron beam for generating a first focal spot on the anode and a second electron emitter adapted for emitting a second electron beam for generating a second focal spot on the anode. Furthermore, each electron emitter comprises its own associated switchable grid for blocking the respective emitted electron beam.

This first aspect of the present invention may be seen as based on the following idea:

Instead of providing a single electron emitter for emitting a single electron beam from the cathode to the anode and then temporarily deflect this single electron beam to different focal spot positions by magnetic or electrostatic deflection means, the present invention proposes to provide two separate electron emitters for enabling a generation of two separate electron beams which impinge on the anode at distinct focal spots.

As X-ray beams from the distinct focal spots should usually not be emitted simultaneously but only one X-ray beam coming from one of the focal spots should be emitted at a time, each of the electron emitters of the cathode comprises its associated switchable grid. This switchable grid, which is sometimes also referred to as grid switch, is adapted for blocking electrons emitted from the respective electron emitter from reaching the anode. For example, each switchable grid may be adapted such that upon electrostatically charging the grid, an electrical field is established such that an electrical acceleration field otherwise existing between the cathode and the anode is locally blocked, i.e. is prevented from reaching the respective electron emitter. Accordingly, when the switchable grid is switched to a blocking state or ON state, no electrons are accelerated from the associated electron emitter towards the respective focal spot on the anode.

Accordingly, a simple X-ray tube design may be provided in which different focal spots may be generated on an anode's X-ray emitting surface by electron beams each coming from one of a plurality of electron emitters, wherein each focal spot may be activated or disactivated by non-blocking (OFF state) or blocking (ON state) the electron beam emitted by the respective electron emitter using the associated switchable grid.

As the switchable grids may be activated or disactivated very fast, it may be possible to very rapidly switch between an X-ray beam coming from the first focal spot and an X-ray beam coming from the second focal spot.

By rapidly switching between the two distinct X-ray beams during acquisition for example in a rotating CT scanner, two different images in the patient plane may be acquired by alternately projecting X-ray beams through the patient at slightly displaced projection directions. Thereby, the overall resolution of an X-ray image acquired by a multi-pixel X-ray detector may be significantly enhanced.

Possible features and advantages of an X-ray tube according to embodiments of the present invention are described in the following.

The cathode of the X-ray tube comprises at least one first electron emitter and at least one second electron emitter. Each of the electron emitters may be provided as heatable filaments which may be heated to substantial temperatures of e.g. more than 1000° C. such as to thermionically emit electrons. Alternatively, other types of electron emitters may be used such as electron emitters based on electric field emission. The electron emitters may be adapted, for example due to their geometric structure, due to their geometric arrangement and/or due to the electric field applied between the cathode and the anode, for emitting respective electron beams in a y-direction towards an X-ray emitting surface of the anode. Thereby, a focal spot may be generated at the X-ray emitting surface.

The anode may be provided with a shape of a disk and may be adapted for rotating around the y-direction. On such rotating anode, a focal spot will travel along a focal track on a circumference of the disk-shaped anode. Accordingly, the thermal energy absorbed within the focal spot due to the impinging electrons will be distributed along the focal track thereby reducing any cooling requirements for the anode's focal spot region.

The anode may have an X-ray emitting surface which is arranged such as to emit X-rays substantially in a z-direction perpendicular to the y-direction upon incidence of an electron beam on a focal spot. The X-ray emitting surface may be slanted, i.e. arranged at an angle of e.g. between 78° and 84°, with respect to the y-direction.

Preferably, the first and second electron emitters are displaced with respect to each other in the z-direction. In other words, geometric centres of the first electron emitter and of the second electron emitter are spaced apart from each other when projected in the z-direction. Due to such displaced or spaced apart arrangement of the first and second electron emitters in the z-direction, the electron beams emitted in the y-direction from the first and second electron emitters will impinge onto the slanted X-ray emitting surface of the anode with a certain displacement in z-direction as well. Due to the slanted arrangement of the X-ray emitting surface, such displacement in z-direction will result in a displacement in the y-direction of the respective X-ray beams emitted from the first and second focal spots. Accordingly, the spaced apart provision of two separate electron emitters displaced in z-direction allows to generate X-rays emitted in z-direction along paths slightly displaced in y-direction. Each X-ray beam may create an X-ray projection through an object to a detector arranged at an opposite side of the object. Having two X-ray beam paths may allow doubling the information detected by the X-ray detector thereby significantly increasing the resolution of acquired X-ray images.

Preferably, the first and second electron emitters are adapted such that the first and second focal spots are aligned in an x-direction. Therein, the x-direction is perpendicular to both, the y-direction and the z-direction. In other words, while the first and second focal spots may be displaced in a z-direction, they shall preferably be aligned, i.e. not displaced, in the x-direction.

Such alignment in x-direction may be obtained by specifically arranging the first and second electron emitters together with their associated switchable grids. For example, each electron emitter may be provided as a longitudinal heatable filament extending in the z-direction. The filaments of the first and second electron emitters may be arranged parallel to each other at a specific distance to each other in x-direction and with a specific displacement in z-direction. In order to compensate the distance between the filaments in x-direction, the filament and its associated switchable grid of the first electron emitter may be arranged at an angle with respect to the filament and its associated switchable grid of the second electron emitter. Accordingly, the first electron beam is emitted at an angle with respect to the second electron beam. The angle may be chosen such that the first and second electron beams impinge onto the X-ray emitting surface of the anode along a line in the x-direction such that the first and second focal spots are aligned in the x-direction.

Preferably, the first and second electron emitters are adapted such that the first and second focal spots overlap in the z-direction. In other words, while the centres of the first and second focal spots may be displaced in z-direction with respect to each other, the areas of the first and second focal spots may nevertheless overlap in z-direction as may be the case if the extension of the focal spots in z-direction is larger than the displacement between the focal spots in z-direction.

Preferably, the switchable grids associated to each of the first and second electron emitters are adapted to be operated independent of each other. In other words, while the switchable grid associated to the first electron emitter may be switched OFF thereby allowing transmission of electrons from the first electron emitter to the anode, the switchable grid associated to the second electron emitter may be independently operated for example to an ON-state in which electrons emitted from the second electron emitter are blocked from travelling to the anode. Accordingly, by switching the switchable grids to an ON-state or OFF-state, the respective focal spots may be independently switched ON or OFF.

The switchable grids associated to one of the first and second electron emitters may be adapted to be electrostatically charged such as to locally shield an electrical field between the anode and the cathode from reaching the respective electron emitter. In other words, an electrical voltage may be applied to the switchable grids such as to establish an electrical potential which at least compensates the electrical field between the anode and the cathode such that in the neighbourhood of the electron emitter there is no electrical field accelerating electrons in a direction towards the anode. Such function of selectively blocking or passing electrons by specifically influencing an electric field may be realized by specifically adapting a geometry and arrangement of grid plates of each switchable grid as well as by specifically selecting voltages applied to the grid plates. For example, the switchable grid associated to one of the first and second electron emitters may comprise two electrostatically chargeable grid plates arranged on opposite sides of the respective electron emitter.

A voltage supplied by control to the switchable grid may be used to thereby control an x-deflection and/or a width of an associated focal spot. The applied voltage may be controlled such as to influence an electrical field in the neighbourhood to the switchable grid in order to thereby control the path and/or focusing of the respective electron beam emitted by the electron emitter.

For example, the grids associated to the first and second electron emitters respectively may be arranged at an angle to one another such as to emit first and second electron beams with respective x-deflections such that the generated first and second focal spots are aligned along the x-direction.

Preferably, the X-ray tube comprises a control which is adapted for applying a blocking voltage to at least one of the switchable grids of the first and second electron emitters. In other words, at a given point in time, at least one of the switchable grids associated to the first and second electron emitters is switched to an ON-state such as to block any electron beam from a respective electron emitter. Accordingly, at most one of the first and second focal spots is irradiated at a given point in time and the first and second focal spots are not irradiated simultaneously.

Preferably, the control is adapted for either applying a blocking voltage to the switchable grid of the first electron emitter or for applying a blocking voltage to the switchable grid of the second electron emitter. For example, the control periodically alternately applies a blocking voltage to the switchable grid of the first electron emitter and to the switchable grid of the second electron emitter. Such blocking voltages may be alternately applied at switching frequencies of for example more than 4 kHz, preferably more than 10 kHz. By periodically alternately applying blocking voltages to the respective switchable grids, the first focal spot and the second focal spot may be alternately operated such that X-ray beams are alternately emitted along a first X-ray beam path and a second X-ray beam path slightly displaced with respect to the first X-ray beam path. Thereby, virtually two distinct X-ray sources slightly displaced with respect to each other may be generated and operated alternately such that X-ray projections along alternating projection planes may be transmitted to an object to be observed and then detected by an X-ray detector. For example, in the case of a rotating CT scanner, the switching frequency with which different X-ray beams are operated alternately may be chosen as high as to thereby generate additional imaging information due to the two distinct projections through the object in order to thereby increase the overall resolution of the CT scanning system.

According to a further aspect of the present invention, a medical device comprising an X-ray tube as described above is proposed. The medical device may be any medical X-ray device such as for example a high quality CT X-ray scanner.

It has to be noted that aspects and embodiments of the present invention have been described with reference to different subject-matters. In particular, some embodiments are described with reference to the proposed X-ray tube whereas other embodiments are described with reference to a medical X-ray device using such X-ray tube or with reference to a method of operating such X-ray tube. However, a person skilled in the art will gather from the above and the following description that, unless other notified, in addition to any combination of features belonging to one type of subject-matter also any combination between features relating to different subject-matters is considered to be disclosed with this application.

BRIEF DESCRIPTION OF THE DRAWINGS

Features and advantages of the present invention will be further described with respect to specific embodiments as shown in the accompanying figures but to which the invention shall not be limited.

All figures are only schematical representations and not to scale. Same reference signs in the figures refer to same or similar features.

DETAILED DESCRIPTION OF EMBODIMENTS

Figure 1:
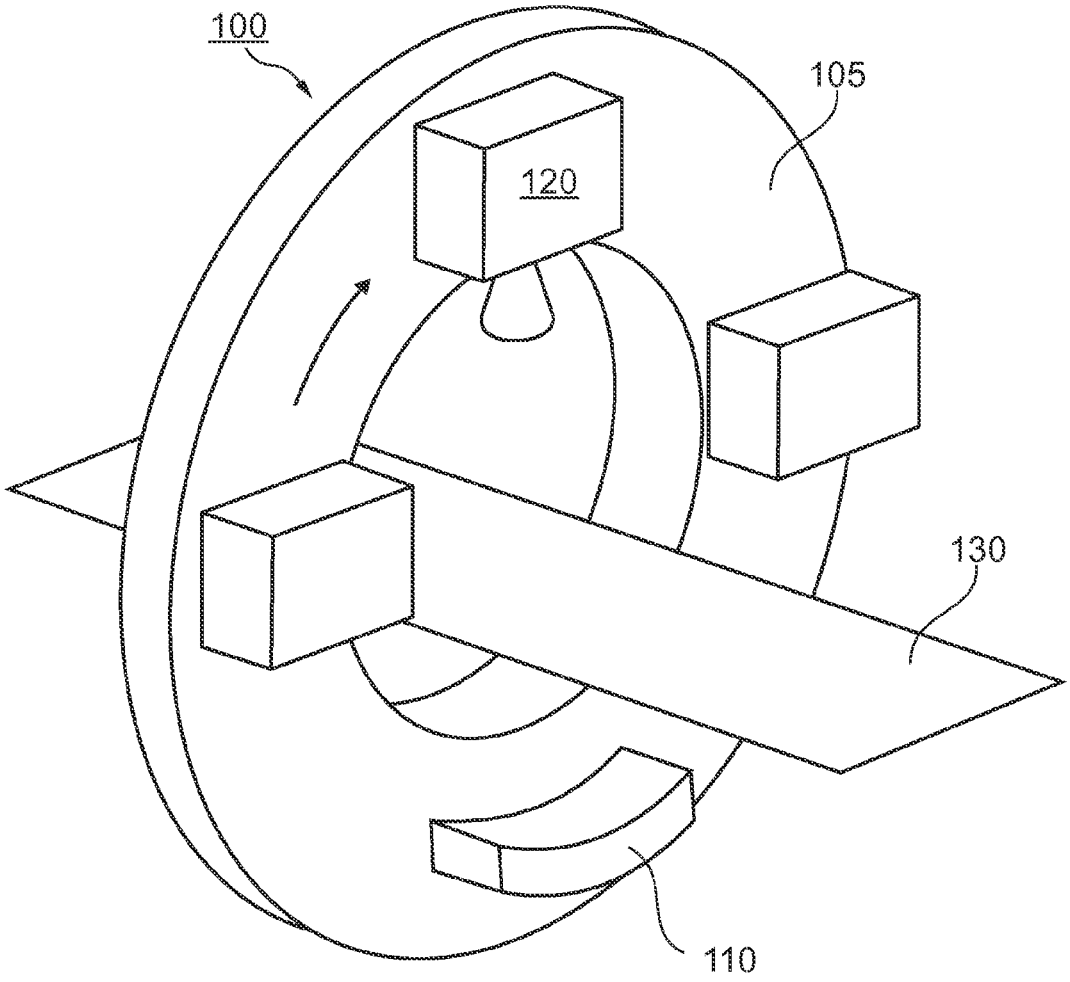
FIG. 1 shows a CT scanner.

FIG. 1 shows basic components of an exemplary medical device 100 in a form of a computer tomography scanner as used in medical facilities. The CT scanner comprises an examination table 130 suitable for positioning an object, for example a patient, of which projection images are to be taken. The CT scanner further comprises a rotatable gantry 105 suitable for rotation around the examination table 130. The examination table 130 is arranged substantially in the centre of the gantry 105. The CT scanner further comprises an X-ray source 120 and a detector 110. The X-ray tube and the detector 110 are diametrically arranged on the gantry 105. During image acquisition phase, the gantry 105 rotates around the examination table 130 while the X-ray source 120 emits X-rays. The emitted X-rays interact with the object deposited on the examination table 130 and the interacting X-rays are then incident on the detector 110. The incident X-rays define a pattern of points of intensities which are digitally transformed into a corresponding pattern of pixels. The pattern of pixels is then available as the projection image of the examined object. The digital projection image can then be stored and/or post-processed by suitable software to be viewable on a monitor. For example, the slices obtained from the detection results acquired at one revolution of the gantry may be used to calculate a 3D image of the object.

Figure 2:
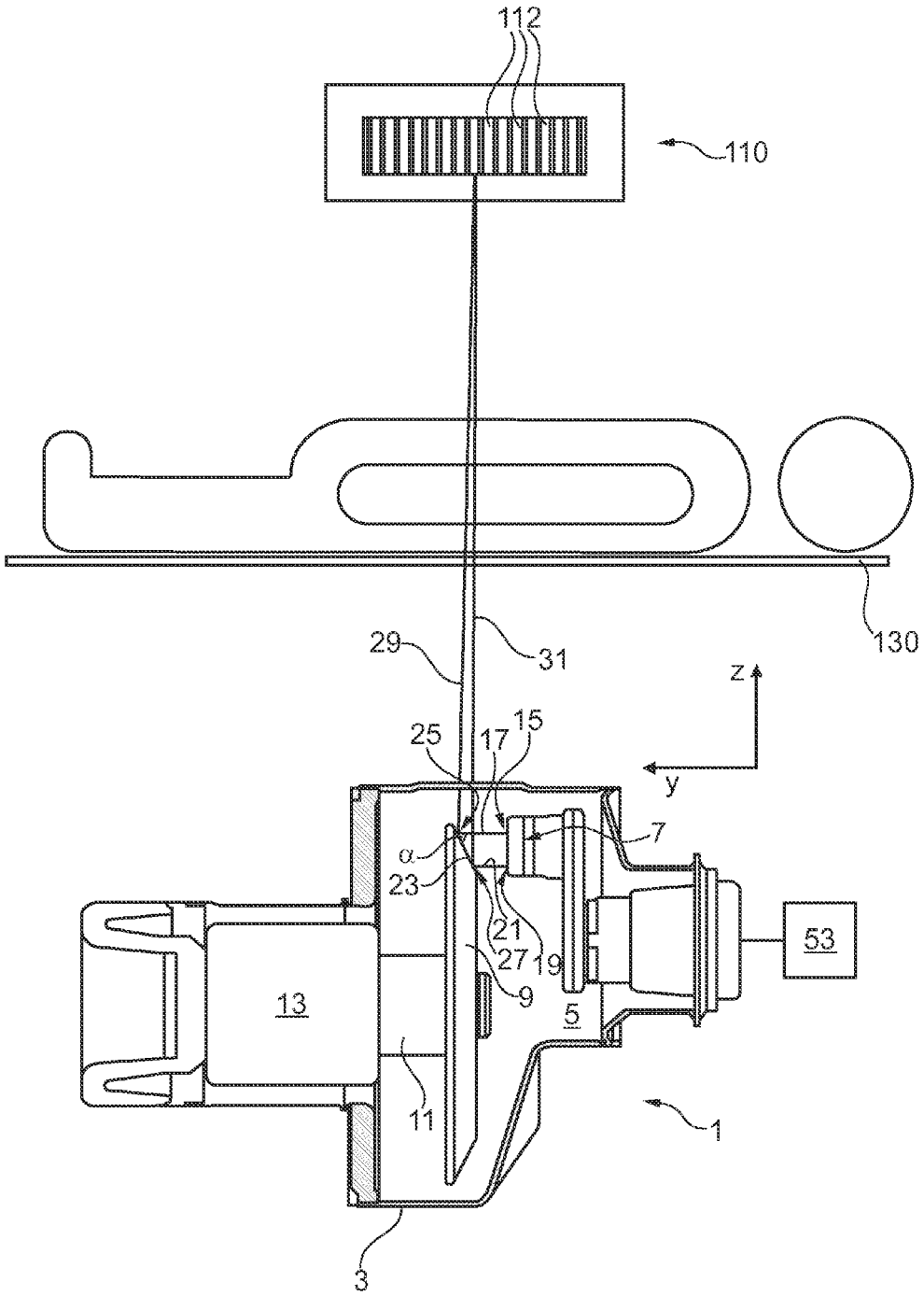
FIG. 2 shows a schematical representation of X-ray projections within a CT scanner using an X-ray tube according to an embodiment of the present invention.

FIG. 2 shows a schematic representation of the arrangement of an X-ray tube 1 serving as an X-ray source 120, a patient lying on an examination table 130 and an X-ray detector 110 arranged at an opposite side.

The X-ray tube 1 comprises a housing 3. The housing 3 encloses a vacuum space 5 in which a cathode 7 and an anode 9 are arranged. The anode has a disk-shape and can be rotated around the rotation axis 11 and may be driven by a motor 13.

The cathode 7 comprises a first electron emitter 15 for emitting a first electron beam 17 and a second electron emitter 19 for emitting a second electron beam 21. The first and second electron beams 17, 21 impinge onto a slanted X-ray emitting surface 23 of the anode 9 and thereby generate respective first and second focal spots 25, 27.

The first and second electron emitters 15, 19 are displaced with respect to each other in the z-direction and emit electron beams 17, 21 in the y-direction. As the X-ray emitting surface 23 is arranged at an angle α of between 45 and 85° with respect to the y-direction, the first and second beams 17, 21 spaced apart in the z-direction impinge onto respective first and second spots 25, 27 which are displaced with respect to each other in the y-direction. While the distance between the first and second electron beams 17, 21, the z-direction, i.e. in a radial direction of the disk-shaped anode 9, may be for example 4.5 mm, the distance of the resulting focal spots 25, 27 in the y-direction, i.e. in an axial direction of the anode 9, may be approximately 0.7 mm.

Accordingly, when the first electron beam 17 impinges onto the first focal spot 25, a first X-ray beam 29 is emitted in the z-direction. This X-ray beam 29 is transmitted through the patient and the resulting X-ray projection is detected in pixels or slices 112 of a one-dimensional X-ray detector 110.

If, alternatively, the second electron beam 21 impinges onto the second focal spot 27, a second X-ray beam 31 is emitted in the z-direction, transmitted through the patient and detected with the detector 110. As the first and second focal spots 25, 27 are displaced in the y-direction by a distance of approximately 0.7 mm, an image displacement within the patient of approximately 0.35 mm may occur. Accordingly, by acquiring two sets of images, one set by transmitting the first X-ray beam 29 through the patient and a second set by transmitting the second X-ray beam 31 through the patient, an additional slice projection through the patient may be acquired. As in conventional CT scanners, the distance or thickness of acquired slice projections may be approximately 0.7 mm, the resolution of such CT scanner may be doubled by providing an additional slice projection at a displacement in y-direction of approximately 0.35 mm.

Figure 3:
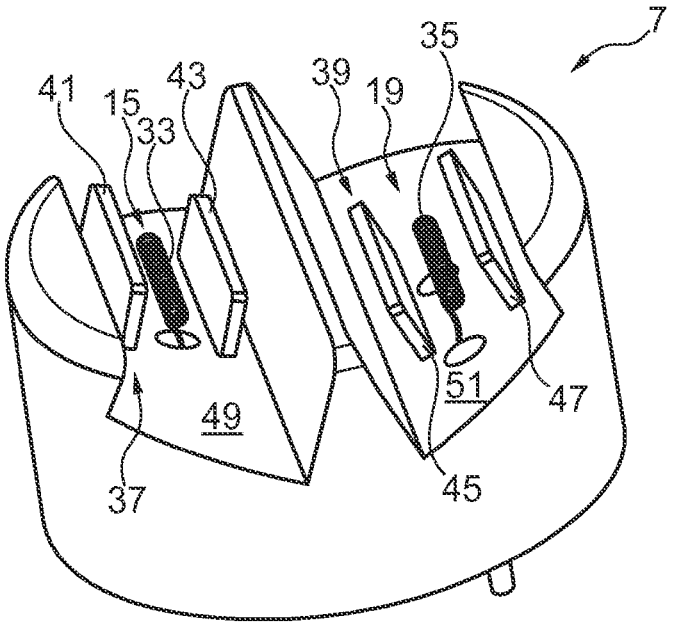
FIG. 3 shows a perspective view of a cathode assembly of an X-ray tube according to an embodiment of the present invention.
Figure 4:
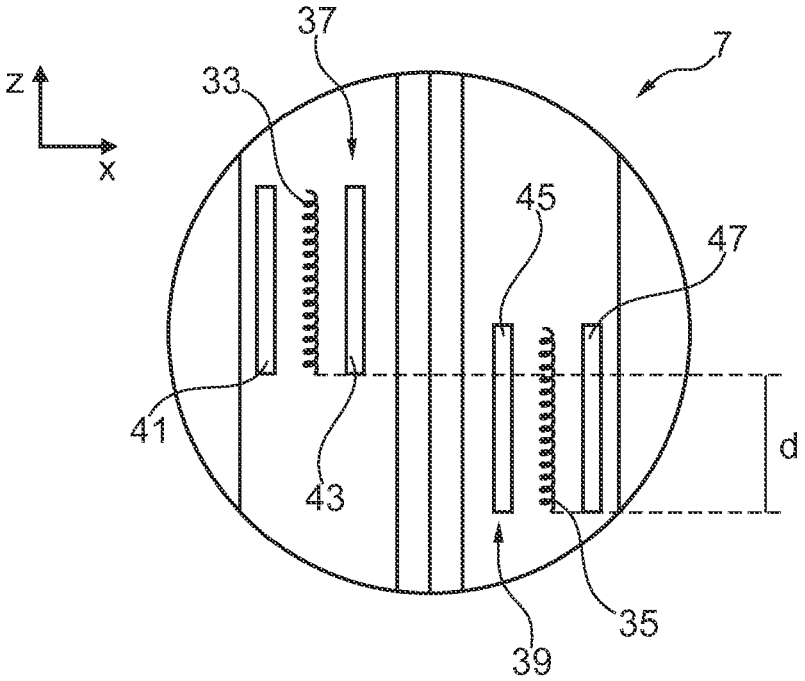
FIG. 4 shows a plan view onto the cathode assembly of FIG. 3.

FIGS. 3 and 4 show a perspective view and a top view of a cathode 7 to be used in an X-ray tube 1 according to an embodiment of the present invention. The cathode 7 comprises two heatable filaments 33, 35 serving as first and second electron emitters 15, 19. The filaments 33, 35 are arranged in parallel directions and are displaced in the z-direction about a distance d=4.5 mm with respect to each other. Each filament 33, 35 has an associated switchable grid 37, 39. Each switchable grid comprises grid switch plates 41, 43 and 45, 47, respectively arranged at opposite sides of the filament 33, 35. The grid switch plates 41, 43, 45, 47 are made from an electrically conductive material such as a metal and may be charged to such electrical potential such as to block or shield an electrical field between the cathode 7 and the anode 9 from reaching the electron emitters 15, 19.

Figure 5:
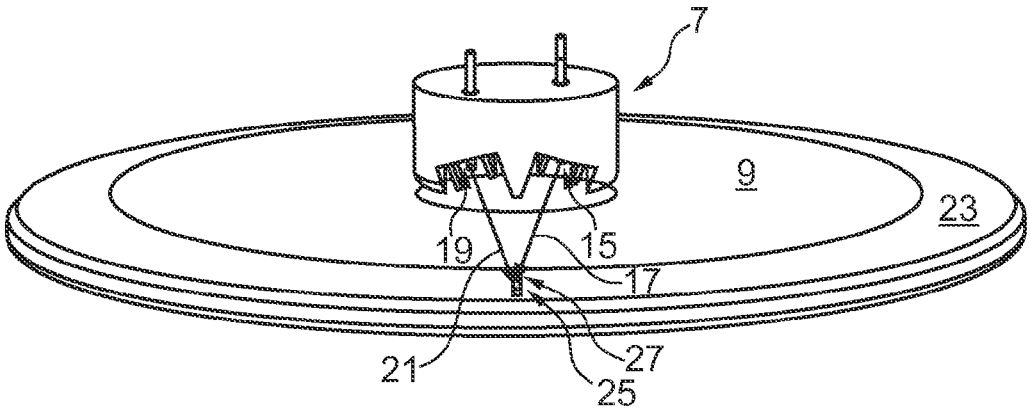
FIG. 5 shows a perspective view of a cathode-anode assembly in an X-ray tube according to an embodiment of the present invention.
Figure 6:
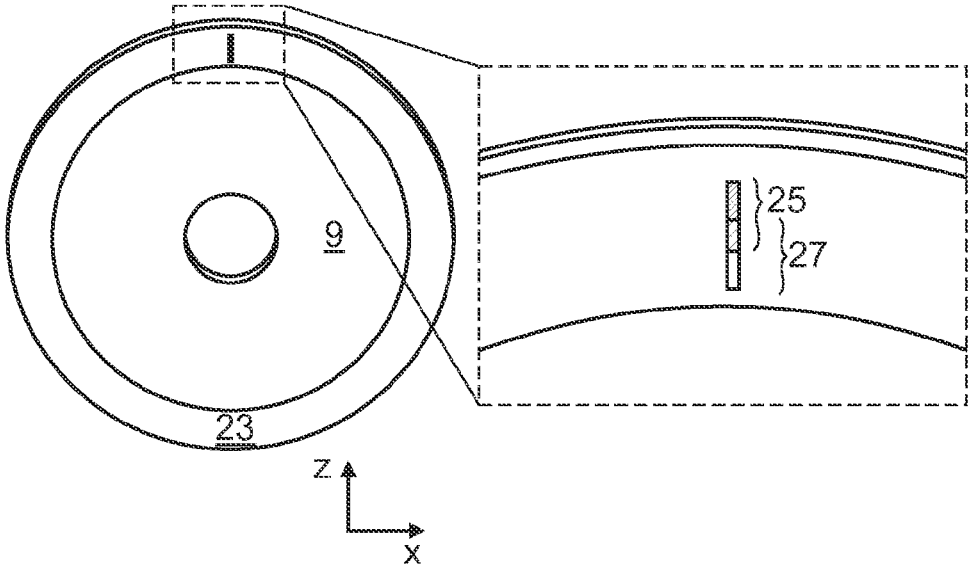
FIG. 6 shows a plan view onto the anode of the assembly shown in FIG. 5.

As may be seen from FIGS. 3 and 4 in conjunction with FIGS. 5 and 6 showing a perspective view and a top view of an anode-cathode arrangement of an X-ray tube according to an embodiment of the present invention, the electron beams 17, 21 emitted from the first and second electron emitters 15, 19 impinge onto slanted X-ray generating surface 23 of the anode 9 at first and second focal spots 25, 27 displaced in z-direction with respect to each other. Therein, the focal spots 25, 27 are aligned with respect to an x-direction. While, as can be seen in FIGS. 3 and 4, the first and second electron emitters 15, 19 are spaced apart from each other in the x-direction, such alignment of the focal spots 25, 27 in x-direction may be achieved by arranging the first electron emitter 15 and its associated switchable grid 37 on a surface 49 of the cathode 7 which is tilted at an angle β of approximately 20 to 50° with respect to a surface 51 of the cathode 7 on which the second electron emitter 19 and its associated switchable grid 39 are arranged. Thereby, the first and second electron beams 17, 21 are emitted in directions having an angle β with respect to each other such that the electron beams 17, 21 impinge onto focal spots 25, 27 which are aligned in x-direction.

As can be seen in FIG. 6, the focal spots 25, 27 have a rectangular, longitudinal shape and overlap along the z-direction. However, a control 53 for energizing and controlling the electron emitters 15, 19 and the switchable grids 37, 39 is adapted to apply a blocking voltage at least to one of the switchable grids 37, 39 at any point in time such that only one of the focal spots 25, 27 is irradiated by electrons at a given point in time. The control 53 may periodically switch one of the switchable grids 37, 39 from an OFF-state to an ON-state and back while alternately switching the other switchable grid 39, 37 from an ON-state to an OFF-state and back at a frequency of for example 10 kHz.

It should be noted that the term "comprising" does not exclude other elements or steps and the term "a" or "an" does not exclude a plurality of elements. It should also be noted that reference signs in the claims should not be construed as limiting the scope of the claims.

LIST OF REFERENCE SIGNS

1 X-ray tube
3 Housing
5 Vacuum space
7 Cathode
9 Anode
11 Rotating axis
13 Motor
15 First electron emitter
17 First electron beam
19 Second electron emitter
21 Second electron beam
23 X-ray emitting surface
25 First focal spot
27 Second focal spot
29 First X-ray beam
31 Second X-ray beam
33 Filament
35 Filament
37 First switchable grid
39 Second switchable grid
41 Grid switch plate
43 Grid switch plate
45 Grid switch plate
47 Grid switch plate
49 Tilted surface of cathode
51 Tilted surface of cathode
53 Control
100 CT scanner
105 Gantry
110 X-ray detector
120 X-ray source
130 Examination table

The invention claimed is:

1. An X-ray tube comprising:

a cathode;

an anode;

wherein the cathode comprises a first electron emitter adapted for emitting a first electron beam for generating a first focal spot on the anode and a second electron emitter adapted for emitting a second electron beam for generating a second focal spot on the anode;

wherein each electron emitter comprises an associated switchable grid for blocking the respective emitted electron beam, said emitting of the first and second electron emitters each being in a y-direction towards the anode, said anode having an X-ray emitting surface for emitting X-rays substantially in a z-direction perpendicular to the y-direction upon incidence of a beam from among the electron beams, the X-ray emitting surface being slanted at an angle with respect to the y-direction, the first and second electron emitters being disposed displaced with respect to each other in the z-direction.

2. The X-ray tube of claim 1, wherein the anode has a disc-shape and is adapted for rotating around the y-direction.

3. An X-ray tube comprising:

a cathode;

an anode;

wherein the cathode comprises a first electron emitter adapted for emitting a first electron beam for generating a first focal spot on the anode and a second electron emitter adapted for emitting a second electron beam for generating a second focal spot on the anode, the first and second focal spots being disposed displaced with respect to each other;

wherein each electron emitter comprises an associated switchable grid for blocking the respective emitted electron beam, wherein the first and second electron emitters are adapted such that the first and second focal spots are aligned in a x-direction perpendicular to the y-direction and perpendicular to the z-direction, wherein the first and second electron emitters comprise first and second heatable filaments, respectively, arranged parallel to each other.

4. An X-ray tube comprising:

a cathode;

an anode;

wherein the cathode comprises a first electron emitter adapted for emitting a first electron beam for generating a first focal spot on the anode and a second electron emitter adapted for emitting a second electron beam for generating a second focal spot on the anode, the first and second focal spots being disposed displaced with respect to each other;

wherein each electro emitter comprises as associated switchable grid for blocking the respective emitted electron beam, wherein the first and second electron emitters are adapted such that the first and second focal spots are aligned in an x-direction perpendicular to the y-direction and perpendicular to the z-direction, where each of said switchable grids comprises two electrostatically chargeable grid plates arranged on opposite sides of the respective electron emitter.

5. An X-ray tube comprising:

a cathode; and an anode, said cathode including: a) a first electron emitter configured for emitting a first electron beam for generating a first focal spot on said anode; and b) a second electron emitter configured for emitting a second electron beam for generating a second focal spot on said anode, the first and second focal spots being disposed displaced with respect to each other, each of the first and second electron emitters comprising an associated switchable grid, said X-ray tube being configured for, via each of the associated switchable grids, blocking the respective emitted electron beam, said switchable grids comprising corresponding grid plates, said blocking comprising specifically adapting, a geometry and arrangement of respective ones of said grid plates.

6. The X-ray tube of claim 5, said blocking by the associated switchable grid comprising locally shielding an electrical field between said anode and said cathode from reaching a respective one of said first and second electron emitters.

7. The X-ray tube of claim 5, said blocking comprising applying, to the associated switchable grid, an electrical voltage to establish an electrical potential that at least compensates an existing electrical field between said anode and said cathode such that, in a neighborhood of the respective one of said first and second electron emitters, there exists no electrical field accelerating, electrons in a direction toward the anode.

8. The X-ray tube of claim 5, said switchable grids comprising corresponding grid plates, said blocking comprising specifically selecting voltages and applying the selected voltages to said grid plates.

9. The X-ray tube of claim 5, configured for switching, from an off-state to an on-state, a grid, from among said grids, to perform said blocking of the respective emitted electron beam.

10. A non-transitory computer readable medium embodying a program for controlling operation of an X-ray tube, said X-ray tube comprising:

a cathode; and an anode, said cathode including: a) a first electron emitter configured for emitting a first electron beam for generating a first focal spot on said anode; and b) a second electron emitter configured for emitting a second electron beam for generating a second focal spot on said anode, the first and second focal spots being disposed displaced with respect to each other, each of the first and second electron emitters comprising an associated switchable grid, said X-ray tube being configured for, via each of the associated switchable grids, blocking the respective emitted electron beam, said program having instructions executable by a processor for performing a plurality of acts, among said plurality there being the act of:

applying a Hocking voltage to at least one of the switchable grids of the first and second electron emitters, said emitting of the first and second electron matters each being in a y-direction towards the anode, said anode having an X-ray emitting surface for emitting X-rays substantially in a z-direction perpendicular to the y-direction upon incidence of a beam from among the electron beams, the X-ray emitting surface being slanted at an angle with respect to the y-direction, the first and second electron emitters being disposed displaced with respect to each other in the z-direction.

11. The X-ray tube of claim 5, wherein the anode has a disc-shape and is adapted for rotating around an axis M the y-direction.

* * * * *